US008632932B2

(12) United States Patent
Sabu et al.

(10) Patent No.: US 8,632,932 B2
(45) Date of Patent: Jan. 21, 2014

(54) TONER, COLOR TONER SET, DEVELOPER, PROCESS CARTRIDGE, AND IMAGE FORMING METHOD

(75) Inventors: Akiyoshi Sabu, Numazu (JP); Akihiro Kotsugai, Numazu (JP); Ryota Inoue, Mishima (JP); Keiko Osaka, Mishima (JP); Shingo Sakashita, Numazu (JP); Yukiko Nakajima, Numazu (JP); Satoshi Mochizuki, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 335 days.

(21) Appl. No.: 12/650,099

(22) Filed: Dec. 30, 2009

(65) Prior Publication Data

US 2010/0183967 A1 Jul. 22, 2010

(30) Foreign Application Priority Data

Jan. 22, 2009 (JP) ..... 2009-011739
Apr. 15, 2009 (JP) ..... 2009-098732
Sep. 24, 2009 (JP) ..... 2009-219078

(51) Int. Cl.
*G03G 9/087* (2006.01)

(52) U.S. Cl.
USPC ..... 430/107.1; 430/108.1; 430/108.2; 430/108.4; 430/109.4

(58) Field of Classification Search
USPC ..... 430/105, 109.4, 48, 108.1, 108.2, 108.4
See application file for complete search history.

(56) References Cited

U.S. PATENT DOCUMENTS

2005/0214669 A1* 9/2005 Hayashi et al. ..... 430/109.4
2007/0015077 A1* 1/2007 Yamashita et al. ..... 430/109.4
2007/0160782 A1* 7/2007 Yatsuzuka et al. ..... 428/34.2
2008/0160435 A1* 7/2008 Lim et al. ..... 430/48
2008/0227002 A1 9/2008 Moriya et al.
2008/0311500 A1* 12/2008 Yamada et al. ..... 430/105
2009/0003885 A1 1/2009 Sabu et al.
2009/0142687 A1* 6/2009 Ariyoshi et al. ..... 430/109.4
2009/0170020 A1* 7/2009 Kubo et al. ..... 430/109.4

FOREIGN PATENT DOCUMENTS

| | | |
|---|---|---|
| JP | 4-278967 | 10/1992 |
| JP | 5-232840 | 9/1993 |
| JP | 7-72696 | 3/1995 |
| JP | 7-248662 | 9/1995 |
| JP | 8-106195 | 4/1996 |
| JP | 9-200551 | 7/1997 |
| JP | 09-274335 | 10/1997 |
| JP | 10-123853 | 5/1998 |
| JP | 10-207174 | 8/1998 |

(Continued)

OTHER PUBLICATIONS

Office Action in corresponding Japanese Application No. 2009-219077, dated Oct. 7, 2013.

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

A toner including a binder resin comprising a resin (a) comprising a polyhydroxycarboxylic acid skeleton formed from an optically-active monomer. The polyhydroxycarboxylic acid skeleton has a weight average molecular weight of from 7,000 to 60,000. The binder resin comprises the polyhydroxycarboxylic acid skeleton in an amount of from 10 to 90% by weight. The optical purity X (%) of the polyhydroxycarboxylic acid skeleton represented by the following formula is 80% or less:

$$X(\%)=|X(L\text{-isomer})-X(D\text{-isomer})|$$

wherein X(L-isomer) and X(D-isomer) represent molar ratio (%) of L-isomer and D-isomer of the optically-active monomer, respectively.

18 Claims, 1 Drawing Sheet

(56) References Cited

FOREIGN PATENT DOCUMENTS

| | | |
|---|---|---|
| JP | 11-7174 | 1/1999 |
| JP | 2001-175022 | 6/2001 |
| JP | 2002-326455 | 11/2002 |
| JP | 2004-012716 | 1/2004 |
| JP | 2006-119654 | 5/2006 |
| JP | 3902733 | 1/2007 |
| JP | 3955459 | 5/2007 |
| JP | 2008-257185 | 10/2008 |
| JP | 2008-262179 | 10/2008 |

* cited by examiner

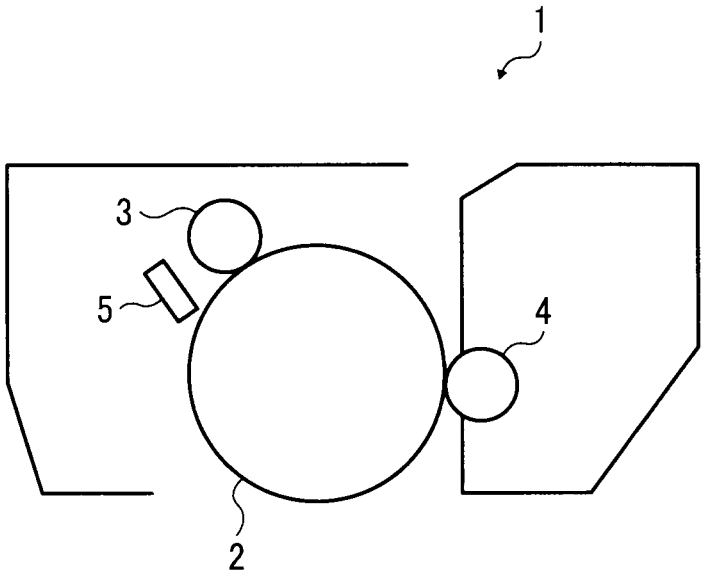
1
3
5
4
2

TONER, COLOR TONER SET, DEVELOPER, PROCESS CARTRIDGE, AND IMAGE FORMING METHOD

BACKGROUND OF THE INVENTION

1. Field of the Invention

The present invention relates to a toner and a color toner set for use in electrophotographic image forming apparatuses such as copiers, printers, and facsimiles. The present invention also relates to a process cartridge and an image forming method using the toner and/or the color toner set.

2. Discussion of the Background

In a typical electrophotographic image formation, a full-color image signal is optically or electrically separated into the subtractive primary colors (i.e., yellow, magenta, and cyan) and black, and dot images of each color are formed. The dot images of each color are superimposed on one another on paper or an intermediate transfer member and finally fixed on paper. Electrophotographic full-color image forming technique has been drastically improved in terms of image quality, however, there is still room for improvement.

Disadvantageously, the minimum dot diameter in electrophotography is still larger than that of offset printing. Also, it is likely that dot diameter is more variable as dot density increases or dot size decreases. With regard to highlight image area, there is an attempt to reduce the number of dots to be written to avoid the above problems. However, this attempt causes another problem that image granularity is variable depending on image density. Compared to offset printing, highlight image area in electrophotographic image is more grainy, because the degree of coloration per dot is high.

In high-density image area, toners of the subtractive primary colors, i.e., yellow, magenta, and cyan are superimposed on one another. In white image area (hereinafter also referred to as "non-image area" or "background area"), paper is exposed. Accordingly, as the image density increases, the amount of toner deposited on paper also increases, and vice versa. In particular, light which has been reflected diffusely at background area is absorbed in toner layers in halftone image area. As a result, the image density visually appears to be higher than the actual dot area ratio in halftone image area. This phenomenon is what is called "optical dot gain". Optical dot gain is one of the reasons for poor reproducibility of highlight image area.

With regard to color images, preferred gloss depends on the kind of image. For example, photographic images with high descriptiveness, such as portraits and landscapes, are generally preferred to have appropriate gloss to provide magnificent texture. In electrophotography, as described above, the amount of toner deposited on paper is different between high-density image area and low-density image area, which provides a difference in surface smoothness. As a result, gloss may vary depending on image density and therefore unevenness in gloss may be observed within a single image, providing us with sense of discomfort. When the difference in gloss is large between background area and image area, text image may also be illegible.

On the other hand, ink-jet recording methods can readily produce full-color images with making little printing noise. Therefore, ink-jet recording methods have been widely used recently in accordance with rapid progress of their printing performance. For example, ink-jet recording methods have been used for recording documents which are written using word-processing software, recording digital images such as digital photographs, making copies of scanned images of beautiful printings such as silver halide photographs and books, and making display images such as posters in a relatively small amount. Recently, in the field of commercial printing that makes various kinds of products in small lots, there are more opportunities that ink-jet recording methods are employed in place of offset printing methods.

Various types of ink-jet recording media have been proposed. For example, normal paper types have been proposed for simply recording texts, on the surface of which texts are directly recorded. Coated paper types having an ink absorbing layer (i.e., a coating layer) have been also proposed, to obtain images with high resolution and high color reproducibility comparable to silver halide photographs. Particularly, cast-coated paper types in which a coating layer is formed by a cast method are preferable when the resultant image requires high gloss. Roller-coated paper types having a thick coating layer are preferable for display images such as posters.

However, it is likely that an ink-jet recording medium which is capable of producing glossy images comparable to glossy offset printings is not commercially available because of its high manufacturing cost.

Ink absorbing layers of coated paper types are required to absorb as large amount as possible of inks because images which require high color reproducibility generally use a large amount of inks. To improve ink absorbing ability, there is an attempt to include a porous substance such as synthetic amorphous silica in an ink absorbing layer. This attempt improves ink absorbing ability but has disadvantages that the resulting image has low gloss and the texture thereof is different from offset printings. The texture of an image formed on a cast-coated-paper-type recording medium is also different from offset printings because the gloss is extremely high and the thickness is very large. The manufacturing costs of the above-described ink-jet recording media are higher than recording media for offset printing because the ink-jet recording media generally include expensive raw materials such as silica, alumina, polyvinyl alcohol, ethylene vinyl acetate emulsions, and ink fixatives (e.g., polyamines, DADMACs, polyamidines) in large amounts.

Conventional ink-jet recording media, particularly glossy ink-jet recording media, are classified into swelling types and void types. The recent mainstream is void types because the drying rate is advantageously very high. A typical void-type recording medium has an ink absorbing layer including voids for incorporating inks, and optionally has a porous gloss layer. Such a void-type recording medium can be prepared by coating a base material with a single layer or multiple layers formed from a liquid in which a silica and/or an alumina hydrate are/is dispersed, and optionally further coating the layer or layers with a gloss layer including a large amount of a colloidal silica. The void-type recording media are designed so as to have affinity for dye-based inks, which are the recent mainstream of inks, and have been widely used as glossy recording media in ink-jet printing.

Glossy ink-jet recording media provide images with high gloss and high definition, however, the manufacturing cost is very higher than that of glossy coated paper for general commercial printings. This is because the raw materials are very expensive and the manufacturing process is complicated. Therefore, glossy ink-jet recording media tend to be used only for high-grade printing such as photographic printing and not to be used for commercial printing of leaflets, catalogs, and brochures which require large output at low cost. In accordance with a recent tendency that the number of color inks used in high-quality images is increased, ink absorbing ability is also required to be more increased. To increase ink absorbing ability of media, one proposed approach involves increasing the thickness of an ink absorbing layer. This approach requires a large amount of expensive raw materials, which results in increase of the price of the resulting medium.

As described above, the mainstream approach of producing high-gloss images in ink-jet recording is to subject recording media to a treatment. However, this approach has a problem of high cost and cannot take advantage of ink-jet recording methods that are capable of printing images on normal paper.

In contrast to ink-jet recording, in electrophotography, toners, more particularly binder resins of the toners, are provided with gloss to produce high-gloss images. However, a color image formed with four toners of cyan, magenta, yellow, and black may have a disadvantage that gloss may vary among image area, non-image area, half-tone image area, and image area in which the density continuously changes.

In attempting to solve the above problem, one proposed approach involves using a transparent toner in addition to yellow, magenta, cyan, and black toners so that the resulting image gloss is adjusted or controlled.

For example, Japanese Patent Application Publication No. (hereinafter JP-A) 07-248662 discloses a color image forming method in which a transparent toner is deposited accordingly in addition to yellow, magenta, cyan, and black toners so that the total amount of the deposited toners becomes always constant.

JP-A 08-106195 discloses a color image forming device in which a transparent toner is deposited first, followed by deposition of yellow, magenta, cyan, and black toners.

JP-A 09-200551 discloses a digital color copying machine in which a transparent toner image is formed with an inverted image signal of any among yellow, magenta, cyan, and black image signals.

JP-A10-123853 discloses an image forming device and method in which a transparent toner layer is formed on an intermediate transfer member and colored toner images are formed thereon.

JP-A 10-207174 discloses a multicolor image printer in which a transparent toner image is superimposed on a colored toner image.

JP-A 11-7174 discloses a multicolor image forming method in which the deposited amount of a transparent toner is adjusted according to the surface roughness of a transfer member.

JP-A 05-232840 discloses a recorder in which surface texture of an image is completely or partially controlled with a transparent toner layer.

JP-A 07-72696 discloses a method for electrostatic photographic printing in which the position and the amount of a transparent toner to be deposited are controllable.

JP-A 04-278967 discloses a method for forming color image in which a transparent toner is deposited on an intermediate transfer member first and then colored toner images are transferred thereon. The resulting layers comprised of the transparent toner and the colored toners are transferred onto a transfer paper and fixed thereon.

The above-described approaches have proposed the use of a transparent toner that is colorless and achromatic. In all of these approaches, the resulting image gloss is made uniform by depositing a transparent toner on low-density image areas or covering all over an image with a transparent toner, which may reduce our sense of discomfort. Such transparent toners produce desired effects so long as the melting properties thereof are optimized.

It is natural that a colored toner that includes a colorant in a large amount and a transparent toner that includes no colorant exhibit different dynamic melting properties when being fixed on a recoding medium. If melting properties of the toners are not controlled appropriately, a colored toner image area and a transparent toner image area may exhibit different gloss and different transparency, which results in deterioration of image quality. Additionally, if melting properties of the colored toner are not adjusted appropriately, it is likely that hot offset problem occurs and an image is not normally formed. If a transparent toner has poor durability, the surface of the resultant image may be easily abraded. As a result, the image may become cloudy and color reproducibility of the image may deteriorate.

In attempting to solve the above-described problem, another proposed approach involves combining ink-jet recording and electrophotography.

For example, JP-A 2002-326455 and Japanese Patent No. 3902733 disclose the following 2 methods:

(1) forming an image on a substrate with an ink by an ink-jet recording method, and exposing the image to a transparent toner; and (2) exposing a substrate to a transparent toner, and forming an image on the substrate with an ink by an ink-jet recording method.

In the above methods, first, the substrate (e.g., paper) is charged. An image is then formed thereon with an ink by an ink-jet recording method so that the charge on the substrate is neutralized by the ink, resulting in formation of a latent image for a transparent toner. Accordingly, the transparent toner is directly deposited on the substrate, the mechanism of which is different from a typical electrophotographic method which includes forming an electrostatic latent image on a photoreceptor, not on paper, depositing a toner on the electrostatic latent image to form a toner image, and transferring the toner image from the photoreceptor onto paper.

More specifically, in the above method (1), the substrate (e.g., paper) is charged and an image is then formed thereon with an ink by an ink-jet recording method. The charge on the substrate is neutralized by the ink. Therefore, an area of the substrate to which the ink is adhered (i.e., an image area) has no charge, whereas an area of the substrate to which the ink is not adhered (i.e., a non-image area) keeps the charge. The transparent toner is selectively deposited on the image area owing to this charge difference between the image area and the non-image area. Accordingly, even if the transparent toner is deposited on whole surface of the substrate, gloss is made uneven because the deposited amount of the transparent toner is different between the image are and the non-image area. In halftone image area, the transparent toner may be deposited in the form of grain or bulk, which may cause local diffused reflection. In a case in which water is adhered to a boundary between the image area and the non-image area, the image area that is covered with the transparent toner may swell due to migration of the water through the paper. As a result, the image may blur and water resistance of the image may deteriorate.

In the above method (2), according to JP-A 2002-326455, a polymer having hydrophilicity and wettability is included in the transparent toner so that an ink-jet image can be formed even on the transparent toner. However, such a toner including a polymer with wettability is likely to adsorb moisture with time, disadvantageously fusing on or aggregating in a toner bottle or a developing device.

As another approach, Japanese Patent No. 3955459 discloses a protective coating which is formed on an ink-jet color image by melting a transparent toner by heat. The transparent toner includes a thermoplastic ionomer that is a polymer resin having a polar group to which a metal ion is added by ionic-biding crosslinking. Because the ionomer has high affinity for metals, the toner may fixedly adhere to a developing sleeve or a carrier with time. Consequently, images are not reliably formed for an extended period of time. Additionally, since ionic-binding substances generally have high water-solubility, the transparent toner including such an ionic-binding substance is likely to adsorb moisture in the air. As a result, disadvantageously, the properties of the transparent toner may vary with time. Ionomer resins advantageously have high strength and high transparency but are disadvantageously expensive compared to general-purpose materials used in electrophotography such as polyester resins, styrene-acrylic resins, and polyolefin resins. There is still no method which can readily produce high-gloss images at low cost, which can replace offset printing.

Accordingly, the background of the present invention can be summarized as follows.

When a transparent toner is used in electrophotography for the purpose of adjusting gloss difference within a single image, controlling the gloss of an image, or adjusting the relation between image density and the deposited amount of toner, the resulting image density and transparency may be not always uniform. The reasons for this have been considered that:

(1) the transparent toner and colored toners have different properties;

(2) a layer of the transparent toner and a combined layer of colored toners and the transparent toner exhibit different glosses; and (3) gloss varies depending on the thickness of a layer of the transparent toner that is formed on a layer of colored toners.

With regard to ink-jet recording, there is a problem that glossy images can be produced only on expensive and exclusive paper without taking advantage of ink-jet recording which is capable of printing images on normal paper.

With regard to methods combining ink-jet recording and electrophotography, there are problems that water resistance of the resulting image is poor because of their mechanism of image forming and that wettability and cost are high because usable raw materials are hydrophilic and expensive.

SUMMARY OF THE INVENTION

Accordingly, an object of the present invention is to provide an electrophotographic toner, a color toner set, a developer, which can produce high quality images with high color reproducibility, gloss uniformity, and durability without causing hot offset.

Another object of the present invention is to provide a process cartridge and an image forming method which can produce images with gloss uniformity on normal paper at low cost without causing hot offset for an extended period of time.

These and other objects of the present invention, either individually or in combinations thereof, as hereinafter will become more readily apparent can be attained by exemplary embodiments described below.

One exemplary embodiment provides a toner, comprising:

a binder resin comprising a resin (a) comprising a polyhydroxycarboxylic acid skeleton formed from an optically-active monomer, wherein the polyhydroxycarboxylic acid skeleton has a weight average molecular weight of from 7,000 to 60,000, wherein the binder resin comprises the polyhydroxycarboxylic acid skeleton in an amount of from 10 to 90% by weight, and wherein the polyhydroxycarboxylic acid skeleton has an optical purity X (%) of 80% or less, the optical purity X (%) is represented by the following formula:

$$X(\%)=|X(L\text{-isomer})-X(D\text{-isomer})|$$

wherein X(L-isomer) and X(D-isomer) represent molar ratio (%) of L-isomer and D-isomer of the optically-active monomer, respectively.

Namely, both transparent and colored toners comprising the resin (a) which has excellent transparency, heat resistance, and durability are provided. By using such a resin for both transparent toner and colored toners, melting properties of the toners are controllable appropriately. In this case, images with high color reproducibility and high durability can be produced without causing hot offset.

Another exemplary embodiment of the present invention provides an image forming method in which an ink image is formed on a recording medium by an ink-jet recording method and a covering layer is formed with the above-described transparent toner so that the covering layer completely or partially covers a surface of the recording medium on which the ink image is formed. This method solves the problems arising in ink-jet recording and methods combining ink-jet recording and electrophotography.

BRIEF DESCRIPTION OF THE DRAWING

These and other objects, features and advantages of the present invention will become apparent upon consideration of the following description of the preferred embodiments of the present invention taken in conjunction with the accompanying drawings, wherein:

FIGURE is a schematic view illustrating an embodiment of the process cartridge of the present invention.

DETAILED DESCRIPTION OF THE INVENTION

An exemplary embodiment of the present invention provides a toner comprising a binder resin comprising a resin (a). The resin (a) comprises a polyhydroxycarboxylic acid skeleton formed from an optically-active monomer. The polyhydroxycarboxylic acid skeleton includes a skeleton in which a hydroxycarboxylic acid is polymerized or copolymerized and is obtainable by directly subjecting a hydroxycarboxylic acid to dehydration condensation or by subjecting a corresponding cyclic ester to ring-opening polymerization. In order to more increase the molecular weight of the resulting polyhydroxycarboxylic acid skeleton, ring-opening polymerization of a cyclic ester is more preferable. A resin comprising the polyhydroxycarboxylic acid skeleton formed from an optically-active monomer has excellent transparency, heat resistance, and durability. From the viewpoint of transparency and thermal properties of the resulting toner, the polyhydroxycarboxylic acid skeleton is preferably formed from an aliphatic hydroxycarboxylic acid or the corresponding cyclic ester, more preferably a hydroxycarboxylic acid having 3 to 6 carbon atoms or the corresponding cyclic ester, and most preferably lactic acid or lactide.

When the optically-active monomer is a cyclic ester of a hydroxycarboxylic acid, the resulting resin has a polyhydroxycarboxylic acid skeleton in which the hydroxycarboxylic acid that forms the cyclic ester is polymerized. For example, when the optically-active monomer is lactide, the resulting resin has a polyhydroxycarboxylic acid skeleton in which lactic acid is polymerized.

The optical purity X (%) of the optically-active monomer that forms the polyhydroxycarboxylic acid skeleton represented by the following formula is preferably 80% or less, and more preferably 60% or less:

$$X(\%)=|X(L\text{-isomer})-X(D\text{-isomer})|$$

wherein X(L-isomer) and X(D-isomer) represent molar ratio (%) of L-isomer and D-isomer of the optically-active monomer, respectively. Within such a range, solvent-solubility and transparency of the resulting resin increase. Needless to say, L-isomer and D-isomer are optical isomers. Generally, optical isomers have the same physical and chemical properties, including reactivity in polymerization, except for optical properties. Therefore, compositional ratio of monomers in the resulting polymer becomes equivalent to that of the monomers actually reacted.

Specific examples of usable hydroxycarboxylic acids for forming the polyhydroxycarboxylic acid skeleton include, but are not limited to, aliphatic hydroxycarboxylic acids (e.g., glycolic acid, lactic acid, hydroxybutyric acid), aromatic hydroxycarboxylic acids (e.g., salicylic acid, creosote acid, mandelic acid, valine acid, syringic acid), and mixtures thereof. Specific examples of the corresponding cyclic esters include, but are not limited to, glycolide, lactide, γ-butyrolactone, and 6-valerolactone. Again, from the viewpoint of the ease of controlling transparency and thermal properties of the resulting toner, the resin (a) preferably includes a polyhydroxycarboxylic acid skeleton formed from an optically-active monomer. Preferably, the optically-active monomer is an aliphatic hydroxycarboxylic acid or the corresponding cyclic ester, more preferably a hydroxycarboxylic acid having 3 to 6 carbon atoms or the corresponding cyclic ester, and most preferably lactic acid or lactide.

At the time a resin having the polyhydroxycarboxylic acid skeleton is formed by polymerization, an alcohol and/or a lactone can be used as co-initiators. As the alcohol, 1,2-propanediol and 1,3-propanediol are preferable from the viewpoint of heat-melting properties of the resulting resin. As the lactone, ϵ-caprolactone is preferable from the viewpoint of heat-melting properties of the resulting resin.

As described above, the optical purity X (%) of the optically-active monomer that forms the polyhydroxycarboxylic acid skeleton represented by the following formula is preferably 80% or less, and more preferably 60% or less:

$$X(\%)=|X(L\text{-isomer})-X(D\text{-isomer})|$$

wherein X(L-isomer) and X(D-isomer) represent molar ratio (%) of L-isomer and D-isomer of the optically-active monomer, respectively. Within such a range, the resulting resin may be amorphous, not crystalline. Therefore, solvents can be easily incorporated in spaces between polymer chains, improving solvent-solubility. With regard to heat-melting properties, the resulting resin may exhibit rubbery region, which is one feature of amorphous polymers, providing appropriate viscoelasticity over a wide range of temperature. Thermal properties such as low-temperature fixability and hot offset resistance are easily controllable by controlling the molecular weight of the resin, the amount of additives (e.g., wax, colorant), and the dispersion state of the additives.

When the optical purity X (%) is beyond the above range, the resulting resin may not be completely amorphous and fine crystals may remain in the resin. Therefore, light may be scattered at interfaces of the crystals, degrading transparency of the resin. Additives such as colorants and waxes may be excluded from the fine crystals and may aggregate or localize in the resulting toner, degrading gloss uniformity and color reproducibility of the resulting images.

Needless to say, L-isomer and D-isomer are optical isomers. Generally, optical isomers have the same physical and chemical properties, including reactivity in polymerization, except for optical properties. Therefore, compositional ratio of monomers in the resulting polymer becomes equivalent to that of the monomers actually reacted.

The polyhydroxycarboxylic acid skeleton formed from an optically-active monomer in the resin (a) preferably has a weight average molecular weight (Mw) of from 7,000 to 60,000, and more preferably from 10,000 to 20,000. When Mw is too small, hot offset resistance of the resulting toner may be poor. When Mw is too large, low-temperature fixability and solvent-solubility of the resulting toner may be poor. Such a toner is difficult to be manufactured by a method in which toner particles are granulated in an aqueous medium.

The toner may include a resin (b) other than the resin (a). Specific preferred examples of the resin (b) include, but are not limited to, vinyl resins, polyester resins, polyurethane resins, epoxy resins, and combinations thereof. More preferably, the resin (b) is a polyester resin or a polyurethane resin. Most preferably, the resin (b) is a polyester resin or a polyurethane resin which includes 1,2-propylene glycol as a constitutional unit. From the viewpoint of controllability of physical properties, straight-chain polyester resins are preferable.

From the viewpoint of transparency and thermal properties of the toner, the toner preferably includes the polyhydroxycarboxylic acid skeleton in an amount of from 10 to 90% by weight, and more preferably from 20 to 80% by weight, based on the total weight of binder resins. When the content of the polyhydroxycarboxylic acid skeleton is too small, high transparency and abrasion resistance cannot be obtained. When the content of the polyhydroxycarboxylic acid skeleton is too large, it may be difficult to manufacture the toner by a method in which toner particles are granulated in an aqueous medium because the viscosity of the resin may increase too much.

The binder resins include the resin (a) having a polyhydroxycarboxylic acid skeleton and the resin (b). When the resin (b) is a prepolymer having a group reactive with an elongating agent, all components reacted with the prepolymer (e.g., the elongating agent) are also regarded as the resin (b). The resin (b) is defined as a resin which functions as a binder resin. Fine resin particles that function as emulsifiers and release agents (e.g., waxes) are not regarded as binder resins in the present specification. Accordingly, the total weight of the resin (a), the resin (b), and the elongating agent is equivalent to the total weight of binder resins in this case.

The resin (a) may be subjected to elongation at the time the toner particles are produced, if needed. In this case, the resin (a) preferably has an isocyanate group and is preferably reacted with an amine which serves as an elongation agent.

The toner including the resin (a) may be either a colored toner including a colorant or a transparent toner including no colorant.

The resin (a) is preferable for transparent toners for use in electrophotographic color image forming methods which use transparent toner. In this case, color images are preferably formed with colored toners including the resin (a) and a transparent toner including the resin (a).

Also, the resin (a) is preferable for transparent toners for use in image forming methods combining ink-jet recording and electrophotography.

The toner of the present invention may include a charge controlling agent, if needed.

Specific examples of usable charge controlling agent include, but are not limited to, quaternary ammonium salts such as benzoyl methyl hexadecyl ammonium chloride and decyl trimethyl ammonium chloride, dialkyl (e.g., dibutyl, dioctyl) tin compounds, dialkyl tin borate compounds, guanidine derivatives, polyamine resins such as vinyl polymers having amino group and condensed polymers having amino group, organic boron salts, fluorine-containing quaternary ammonium salts, and calixarene compounds. Colored charge controlling agents are not preferable while whitish charge controlling agents such as metal salts of salicylic acid derivatives and fluorine-containing quaternary ammonium salts are preferable. Fluorine-containing quaternary ammonium salts can quickly increase the charge amount of toner to a desired level without degrading transparency.

The content of the charge controlling agent is preferably from 0.01 to 2 parts by weight, and more preferably from 0.02 to 1 part by weight, based on 100 parts by weight of the binder resins. When the content is 0.01 parts by weight or more, the toner obtains charge controllability. When the content is 2 parts by weight or less, chargeability of the toner is not too large, charge controllability does not deteriorate, and electrostatic attraction between the toner and a developing roller does not increase too much to cause deterioration of fluidity of the toner and the resulting image density.

To improve charge stability, the toner preferably includes a layered inorganic mineral, the interlayer ions of which are partially or completely modified with an organic substance ion. Specific preferred examples of such layered inorganic minerals include smectite modified with an organic cation. By replacing a part of divalent metals in the layered inorganic mineral with trivalent metals, metals anions can be introduced thereto. Since metal anions are highly hydrophilic, preferably, the metal anions introduced in the layered inorganic mineral are partially or completely modified with an organic anion.

Specific examples of usable organic cation modifying agents include, but are not limited to, quaternary alkylammonium salts, phosphonium salts, and imidazolium salts. Among these modifying agents, quaternary alkylammonium salts are preferable. Specific examples of the quaternary alkylammonium salts include, but are not limited to, trimethyl stearyl ammonium, dimethyl stearyl benzyl ammonium, and oleyl bis(2-hydroxyethyl)methyl ammonium.

Specific examples of usable organic anion modifying agents include, but are not limited to, sulfates, sulfonates, carboxylates, and phosphates, which has a branched, unbranched, or cyclic alkyl (C1-C44), alkenyl (C1-C22), alkoxy (C8-C32), hydroxyalkyl (C2-C22), ethylene oxide, or propylene oxide. Among these modifying agents, carboxylates having an ethylene oxide skeleton are preferable.

By partially or completely modifying interlayer ions in a layered inorganic mineral with an organic substance ion, the layered inorganic mineral is provided with appropriate hydrophobicity. Therefore, a toner components liquid containing the layered inorganic mineral may exhibit non-Newtonian viscous behavior, which allows the toner to have an irregular shape. The content of the layered inorganic mineral partially or completely modified with an organic substance ion is preferably from 0.05 to 10% by weight, and more preferably from 0.05 to 5% by weight, based on total weight of toner components.

Specific examples of usable layered inorganic mineral include, but are not limited to, montmorillonite, bentonite, hectorite, attapulgite, sepiolite, and mixtures thereof. Particularly, organic-modified montmorillonite and bentonite are preferable because of expressing good properties in a small amount without affecting other toner properties. Additionally, the viscosity thereof is easily controllable.

Specific examples of commercially available layered inorganic minerals which are partially modified with an organic cation include, but are not limited to, quaternium-18 bentonite such as BENTONE 3, 38, and 38V (from Elementis Specialties, Inc.), TIXOGEL VP (from United Catalysis Corp.), and CLAYTONE® 34, 40, and XL (from Southern Clay Products, Inc.); stearalkonium bentonite such as BENTONE 27 (from Elementis Specialties, Inc.), TIXOGEL LG (from United Catalysis Corp.), and CLAYTONE® AF and APA (from Southern Clay Products, Inc.); and quaternium-18 benzalkonium bentonite such as CLAYTONE® HT and PS (from Southern Clay Products, Inc.). Among these materials, CLAYTONE® AF and APA are preferably used.

Specific examples of layered inorganic minerals which are partially modified with an organic anion include, but are not limited to, DHT-4A (from Kyowa Chemical Industry Co., Ltd.) modified with an organic anion having the following formula (I):

$$R^1(OR^2)nOSO_3M \quad (1)$$

wherein $R^1$ represents an alkyl group having 13 carbon atoms, $R^2$ represents an alkylene group having 2 to 6 carbon groups, n represents an integer of from 2 to 10, and M represents a monovalent metallic element. Specific examples of commercially available organic anion having the formula (I) include, but are not limited to, HITENOL 330T (from Dai-ichi Kogyo Seiyaku Co., Ltd.).

The colored toner of the present invention includes a colorant.

Specific examples of usable yellow colorants include, but are not limited to, Cadmium Yellow, Mineral Fast Yellow, Nickel Titan Yellow, Naples Yellow, NAPHTHOL YELLOW S, HANSA YELLOW G, HANSA YELLOW 10G, BENZIDINE YELLOW GR, Quinoline Yellow Lake, PERMANENT YELLOW NCG, Tartrazine Lake, and C. I. Pigment Yellow 180.

Specific examples of usable orange colorants include, but are not limited to, molybdenium orange, PERMANENT ORANGE GTR, pyrazolone orange, vulcan orange, INDANTHRENE BRILLIANT ORANGE RK, Benzidine Orange G, and INDANTHRENE BRILLIANT ORANGE GK.

Specific examples of usable red colorants include, but are not limited to, red iron oxide, cadmium red, PERMANENT RED 4R, Lithol Red, Pyrazolone Red, watching red calcium salt, Lake Red D, Brilliant Carmine 6B, Eosin Lake, Rhodamine Lake B, Alizarine Lake, Brilliant Carmine 3B, and C. I. Pigment Red 122.

Specific examples of usable violet colorants include, but are not limited to, Fast Violet B and Methyl Violet Lake.

Specific examples of usable blue colorants include, but are not limited to, cobalt blue, Alkali Blue, Victoria Blue Lake, Phthalocyanine Blue, metal-free Phthalocyanine Blue, partially-chlorinated Phthalocyanine Blue, Fast Sky Blue, INDANTHRENE BLUE BC, and C. I. Pigment Blue 15:3.

Specific examples of usable green colorants include, but are not limited to, Chrome Green, chromium oxide, Pigment Green B, and Malachite Green Lake.

Specific examples of usable black colorants include, but are not limited to, azine dyes (e.g., carbon black, oil furnace black, channel black, lampblack, acetylene black, aniline black), metal salt azo dyes, metal oxides, and combined metal oxides.

These can be used alone or in a combination.

The colored toner preferably includes a colorant in an amount of from 1 to 15% by weight, and more preferably from 3 to 10% by weight. When the amount is too small, the toner may have poor coloring power. When the amount is too large, the colorant may not be uniformly dispersed in the toner, causing deterioration of coloring power and electric properties.

The colorant can be combined with a resin to be used as a master batch. Specific examples of usable resins for master batches include, but are not limited to, polyesters, styrene and substituted styrene polymers, styrene copolymers, polymethyl methacrylates, polybutyl methacrylates, polyvinyl chlorides, polyvinyl acetates, polyethylenes, polypropylenes, epoxy resins, epoxy polyol resins, polyurethanes, polyamides, polyvinyl butyrals, polyacrylic acid resins, rosins, modified rosins, terpene resins, aliphatic and alicyclic hydrocarbon resins, aromatic petroleum resins, chlorinated paraffins, and paraffin waxes. These resins can be used alone or in combination. Particularly, straight-chain polyesters and the resin (a) described above are preferable for the toner of the present invention.

Specific examples of usable styrene and substituted styrene polymers include, but are not limited to, polystyrene, poly(p-chlorostyrene), and polyvinyltoluene. Specific examples of usable styrene copolymers include, but are not limited to, styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers.

The master batches can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading process, dispersing devices capable of applying a high shearing force such as three roll mills can be preferably used.

The toner of the present invention may include a release agent. Specific examples of usable release agents include, but are not limited to, free fatty acid-free carnauba waxes, polyethylene waxes, montan waxes, oxidized rice waxes, and mixtures thereof. Suitable carnauba waxes are in the form of microcrystal and have an acid value of 5 mgKOH/g or less. Preferably, such a carnauba wax is dispersed in binder resin with a dispersion diameter of 1 μm or less. Suitable montan waxes are purified minerals in the form of microcrystal and have an acid value of from 5 to 14 mgKOH/g. Suitable oxidized rice waxes are air-oxidized rice bran waxes and have an acid value of from 10 to 30 mgKOH/g. Because these waxes can be finely dispersed in the binder resins of the present invention, the resulting toner is provided with excellent offset resistance, transferability, and durability. These waxes can be used alone or in combination.

Additionally, conventionally-used waxes such as solid silicone waxes, higher fatty acid higher alcohols, montan ester waxes, polyethylene waxes, polypropylene waxes are also usable in combination with the above waxes.

The release agent preferably has a glass transition temperature (Tg) of from 70 to 90° C. When Tg is too small, heat-resistant storage stability of the toner may be poor. When Tg is too large, the toner may not exhibit releasability at low temperatures, resulting in poor cold offset resistance and the occurrence of paper winding around a fixing roller. The toner preferably includes the release agent in an amount of from 1 to 20% by weight, and more preferably from 3 to 10% by weight, based on the total weight of binder resin. When the amount is too small, the occurrence of offset cannot be prevented. When the amount is too large, transferability and durability of the toner may be poor.

The developer of the present invention comprises the toner of the present invention and optional other components. The developer of the present invention may be either a one-component developer comprising the toner and no carrier or a two-component developer comprising the toner and a carrier. From the viewpoint of lifespan, two-component developers are preferable for high-speed printers being compliant with recent improvement of information processing speed.

A suitable carrier includes a core material and a resin layer that covers the core material.

The core material may be manganese-strontium (Mn—Sr) materials and manganese-magnesium (Mn—Mg) materials having a magnetization of from 50 to 90 emu/g, for example.

In addition, the core material may be a high-magnetization material such as iron powders having a magnetization of 100 emu/g or more or magnetites having a magnetization of from 75 to 120 emu/g. In this case, the resultant image density may be high.

Moreover, the core material may be a low-magnetization material such as copper-zinc (Cu—Zn) materials having a magnetization of from 30 to 80 emu/g. In this case, developer brushes that are formed on a developing roller may softly contact a photoreceptor with making a little impact thereon, resulting in high quality images.

These core materials can be used alone or in combination.

The core material preferably has a weight average particle diameter (D50) of from 10 to 200 μm, and more preferably from 40 to 100 μm. When the weight average particle diameter is too small, the resultant carrier may include a very large amount of ultrafine particles. As a result, the magnetization per particle may decrease and carrier scattering may occur. When the weight average particle diameter is too large, the specific surface area of the resultant carrier may decrease and toner scattering may occur.

Specific examples of usable resins for the resin layer include, but are not limited to, amino resins, polyvinyl resins, polystyrene resins, halogenated polyolefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomers, copolymers of vinylidene fluoride and vinyl fluoride, fluoroterpolymers (such as copolymers of tetrafluoroethylene, vinylidene fluoride, and monomers having no fluoro group), and silicone resins. These resins can be used alone or in combination. Among these resins, silicone resins are most preferable.

Specific examples of usable silicone resins include, but are not limited to, straight silicone resins consisting of organosiloxane bonds, and silicone resins which are modified with alkyd resins, polyester resins, epoxy resins, acrylic resins, and/or urethane resins.

Specific examples of commercially available straight silicone resins include, but are not limited to, KR271, KR255, and KR152 from Shin-Etsu Chemical Co., Ltd.; and SR2400, SR2406, and SR2410 from Dow Corning Toray Co., Ltd.

Specific examples of commercially available modified silicone resins include, but are not limited to, KR206 (alkyd-modified), KR5208 (acrylic-modified), ES1001N (epoxy-modified), and KR305 (urethane modified) from Shin-Etsu Chemical Co., Ltd.; and SR2115 (epoxy-modified) and SR2110 (alkyd-modified) from Dow Corning Toray Co., Ltd.

These silicone resins can be used alone or in combination with other components such as cross-linking agents and charge controlling agents.

The resin layer may include a conductive powder, if needed. Specific examples of usable conductive powders include, but are not limited to, powders of metals, carbon black, titanium oxide, tin oxide, and zinc oxide. The conductive powder preferably has an average particle diameter of 1 μm or less. When the average particle diameter is too large, it is difficult to control electric resistance of the resin layer.

The resin layer may be formed by applying an application liquid on the surface of the core material, followed by drying and baking. The application liquid includes a solvent in which a resin such as a silicone resin is dissolved. The application liquid may be applied by a dip application method, a spraying method, a brush application method, etc.

Specific examples of usable solvents for the application liquid include, but are not limited to, toluene, xylene, methyl ethyl ketone, methyl isobutyl ketone, cellosolve, and butyl acetate.

The baking may be performed by either external heating methods or internal heating methods such as methods using a fixed electric furnace, a fluid electric furnace, a rotary electric furnace, or a burner furnace, and methods using microwave.

The carrier preferably includes the resin layer in an amount of from 0.01 to 5.0% by weight. When the amount is too small, the resin layer may not be evenly formed on the surface of the core material. When the amount is too large, the carrier particles may coalesce with each other because the resin layer is too thick.

The two-component developer preferably includes the toner in an amount of from 1 to 10.0 parts by weight, based on 100 parts by weight of the carrier.

Methods for manufacturing the toner of the present invention are not particularly limited. For example, the toner of the present invention is obtainable by pulverization methods; polymerization methods which directly subject a monomer composition including the resin (a) and a polymerizable monomer to polymerization (e.g., suspension polymerization, emulsion polymerization aggregation); methods in which a composition including the resin (a) and an optional prepolymer having a reactive group is emulsified in an aqueous dispersion of a particulate resin, and the prepolymer is directly subjected to elongation or cross-linking with an amine; methods in which toner components are dissolved in a solvent and pulverized after the solvent is removed from the resulting solution; dissolution suspension methods; and melt-spraying granulation methods.

Typically, a pulverization method is a method in which toner components are melt-kneaded in a process called melt-kneading, the melt-kneaded mixture is pulverized into particles in a process called pulverization, and the particles are classified by size in a process called classification to obtain mother toner particles. In order to more increase the average circularity, the mother toner particles may be subjected to a shape control treatment. The shape control treatment may be performed by applying mechanical impact to the mother toner particles using an apparatus such as HYBRIDIZER (from Nara Machinery Co., Ltd.) and MECHANOFUSION® (from Hosokawa Micron Corporation), for example.

Toner components including the resin (a) are mixed and the resulting mixture is melt-kneaded using a kneader such as a single-axis or double-axis continuous kneader and a batch kneader using a roll mill. Specific examples of commercially available kneaders include, but are not limited to, TWIN SCREW EXTRUDER KTK from Kobe Steel, Ltd., TWIN SCREW COMPOUNDER TEM from Toshiba Machine Co., Ltd., MIRACLE K.C.K from Asada Iron Works Co., Ltd., TWIN SCREW EXTRUDER PCM from Ikegai Co., Ltd., KOKNEADER from Buss Corporation, etc. The melt-kneading process should be performed such that the molecular chains of binder resins are not cut. In particular, the melt-kneading temperature should be determined considering the softening point of binder resin. When the melt-kneading temperature is too lower than the softening point of the binder resin, the molecular chains are cut. When the melt-kneading temperature is too higher than the softening point of the binder resin, toner components cannot be well dispersed.

In the pulverization process, the kneaded mixture is pulverized into particles. It is preferable that the kneaded mixture is pulverized into coarse particles first and the coarse particles are further pulverized into fine particles. Suitable pulverization methods include a method which collides particles with a collision board in a jet stream; a method which collides particles with each other in a jet stream; and a method which pulverizes particles in a narrow gap formed between a rotor mechanically rotating and a stator; etc.

In the classification process, the particles which have produced in the pulverization process are classified by size to obtain desired-size particles. Fine particles can be removed by means of cyclone, decantation, centrifugal separation, etc.

The particles which have subjected to the pulverization and classification processes may be further subjected to a classification in a jet stream using centrifugal force to obtain desired-size particles.

Typically, a suspension polymerization method is a method in which a mixture of the resin (a), an oil-soluble polymerization initiator, and a polymerizable monomer in which a colorant, a release agent, etc., are dispersed is emulsified in an aqueous medium containing a surfactant, a solid dispersing agent, etc. The mixture is subjected to a polymerization to produce mother toner particles. The mother toner particles are subjected to a wet treatment to adhere inorganic fine particles to the surfaces thereof. It is preferable that excessive surfactant and/or dispersing agent that remain on the surface of the mother toner particles are removed before subjected to the wet treatment.

When the following polymerizable monomers are used, functional groups can be introduced to the surfaces of the resulting mother toner particles: acids such as acrylic acid, methacrylic acid, α-cyanoacrylic acid, itaconic acid, crotonic acid, fumaric acid, maleic acid, and maleic anhydride; acrylamide, methacrylamide, diacetone acrylamide, and methylol compounds thereof; acrylates and methacrylates having an amino group such as vinylpyridine, vinylpyrrolidone, vinylimidazole, ethyleneimine, and dimethylaminoethyl methacrylate.

When the dispersing agent has an acid group or a basic group, the dispersing agent is adsorbed and remains on the resulting mother toner particles, thereby introducing functional groups on the surfaces thereof.

Typically, an emulsion polymerization aggregation method is a method in which a water-soluble polymerization initiator and a polymerizable monomer are emulsified in an aqueous medium containing a surfactant so that a latex is prepared by typical means of emulsion polymerization. Independent dispersions in which a colorant and a release agent are respectively dispersed in aqueous media are mixed with the latex and dispersoids are aggregated so as to have a desired size. The resulting aggregations are heated to be fused. Thus, mother toner particles are prepared. The particles are subjected to a wet treatment to adhere inorganic fine particles to the surfaces thereof. The above-described polymerizable monomers usable for suspension polymerization methods are also usable in emulsion polymerization aggregation methods so as to introduce functional groups to the surfaces of the resulting mother toner particles.

A typical method in which a composition including the resin (a) and an optional prepolymer having a reactive group is emulsified in an aqueous dispersion of a particulate resin is described in detail below. First, a composition or solvent solution containing the resin (a) and an optional prepolymer having a reactive group is dispersed in an aqueous dispersion of a particulate resin. When the prepolymer is present, the prepolymer is subjected to elongation or cross-linking with an amine. Because of being formed in the aqueous dispersion of a particulate resin, the resulting mother toner particles have the particulate resin on the surfaces thereof. The aqueous medium is removed after the mother toner particles are formed. The reactive group in the prepolymer is preferably an isocyanate group, a blocked isocyanate group, or an epoxy group, and most preferably an isocyanate group.

The aqueous medium can be prepared by dispersing a particulate resin in an aqueous solvent.

Specific examples of the aqueous solvents include, but are not limited to, water and water-miscible solvents. These aqueous solvents can be used alone or in combination. Among these aqueous solvents, water is preferable. Specific examples of usable water-miscible solvents include, but are not limited to, alcohols (e.g., methanol, isopropanol, ethylene glycol), dimethylformamide, tetrahydrofuran, cellosolves, and lower ketones (e.g., acetone, methyl ethyl ketone).

Specific preferred materials for the particulate resin include, but are not limited to, thermoplastic and thermosetting resins which can be dispersed in an aqueous solvent, such as vinyl resins, polyurethane resins, epoxy resins, polyester resins, polyamide resins, polyimide resins, silicone resins, phenol resins, melamine resins, urea resins, aniline resins, ionomer reins, and polycarbonate resins. These resins can be used alone or in combination. Among these resins, vinyl resins, polyurethane resins, epoxy resins, and polyester resins are preferable because aqueous dispersions containing fine spherical particles thereof are easily obtainable. Specific examples of the vinyl resins include, but are not limited to, resins obtained from homopolymerization or copolymerization of vinyl monomers, such as styrene-(meth)acrylate copolymers, styrene-butadiene copolymers, (meth)acrylic acid-acrylate copolymers, styrene-acrylonitrile copolymers, styrene-maleic anhydride copolymers, and styrene-(meth) acrylic acid copolymers.

The transparent toner of the present invention is usable for all image forming methods which use transparent toner for the purpose of increasing gloss of the resultant images. For example, the transparent toner may be uniformly deposited on a whole surface including both image area and non-image area. Alternatively, a larger amount of the transparent toner is deposited on non-image area than image area so that the same amount of toner is deposited on both the non-image area and the image area. Additionally, the transparent toner may be used for an image forming method in which multiple color images are directly superimposing one another on a substrate (e.g., paper); an image forming method in which multiple color images are superimposing one another on a member other than the substrate, such as an intermediate transfer belt; an image forming method employing 5 stations in which 5 toner images of cyan, magenta, yellow, black, and transparent are superimposed on one another on a substrate and fixed thereon simultaneously; an image forming method employing two 4-tandem apparatuses which are connected with each other so that 4 color images of cyan, magenta, yellow, and black are formed and fixed in the first 4-tandem apparatus and transparent toner images are superimposed thereon in the second 4-tandem apparatus; an image forming method in which a color image is formed on a substrate by an ink-jet method and the transparent toner layer is formed on a whole surface of the substrate.

The toner of the present invention may be contained in a process cartridge comprising an electrostatic latent image bearing member and a developing device, which is detachably mountable on image forming apparatuses.

FIG. 1 is a schematic view illustrating an embodiment of a process cartridge containing the toner of the present invention. A process cartridge 1 includes a photoreceptor 2 serving as an electrostatic latent image bearing member, a charger 3, a developing device 4, and a cleaning device 5. As is shown in FIG. 1, multiple members are integrally combined in the process cartridge 1. The process cartridge 1 is detachably mountable on image forming apparatuses such as copiers and printers.

An operation of an image forming apparatus which contains the above process cartridge containing the toner of the present invention is described as follows.

The photoreceptor 2 is driven to rotate at a predetermined peripheral speed. While the photoreceptor 2 is rotating, the circumferential surface thereof is uniformly charged to a predetermined positive or negative potential by the charger 3 and subsequently exposed to light containing image information by slit exposure or laser beam scanning exposure. As a result, electrostatic latent images are sequentially formed on the circumferential surface of the photoreceptor 2. The electrostatic latent images are developed into toner images by the developing device 4. The toner images are sequentially transferred onto a transfer material (e.g., paper) which is fed from a paper feeding part to a gap between the photoreceptor and a transfer device in synchronization with the rotation of the photoreceptor 2. The transfer material having the toner images thereon is separated from the photoreceptor 2 and introduced to a fixing device so that the toner images are fixed thereon. The resulting printouts are discharged from the image forming apparatus. The circumferential surface of the photoreceptor 2 is cleaned with the cleaning device 5 by removing residual toner particles that remain thereon without being transferred onto the transfer material. The circumferential surface is then neutralized to prepare for a next image forming operation.

Colored images can be formed by ink-jet recording methods as well as electrophotography. Suitable ink-jet recording methods may be continuous types, on demand types, thermal types, and piezo types, for example.

Suitable inks usable for the ink-jet recording methods may be dye-based inks, pigment-based inks, solid inks, and ultraviolet curable inks, for example.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

In the following examples, the weight average molecular weight (Mw) of a resin is measured as follows.

THF-soluble components of a resin are subjected to a GPC (gel permeation chromatography) measurement under the following conditions.

Measuring device: HLC-8120 (from Tosoh Corporation)

Columns: TSKgel GMHXL×2, TSKgel Multipore HXL-M×1

Detector: Refractive index detector

Measuring temperature: 40° C.

Injected sample: 100 μl of 0.25% by weight THF solution

A calibration curve is prepared using polystyrene standard samples.

The weight average molecular weight (Mw) of the polyhydroxycarboxylic acid skeleton in the resin (a) can be determined from the weight average molecular weight (Mw) of the resin (a) measured by the above-described method and the ratio of the polyhydroxycarboxylic acid skeleton to the resin (a) measured by NMR, etc.

Examples 1 to 7

Comparative Examples 1 to 6

Preparation of Resin Dispersion 1

A reaction vessel equipped with a stirrer and a thermometer is charged with 680 parts of water, 13 parts of a sodium salt of sulfate of ethylene oxide adduct of methacrylic acid (ELEMINOL RS-30 from Sanyo Chemical Industries, Ltd.), 80 parts of styrene, 80 parts of methacrylic acid, 105 parts of butyl acrylate, and 2 parts of ammonium persulfate. The mixture is agitated for 1 hour at a revolution of 4,200 rpm. Thus, a whitish emulsion is prepared. Subsequently, the reaction system is heated to 75° C. and the mixture is subjected to a reaction for 4 hours. After adding 30 parts of a 1% by weight aqueous solution of ammonium persulfate, the mixture is subjected to aging for 6 hours at 75° C. Thus, a resin dispersion 1 is prepared.

The volume average particle diameter of the resin dispersion 1 measured by a Particle Size Distribution Analyzer LA-920 (from Horiba, Ltd.) is 50 nm. The glass transition temperature (Tg) and the weight average molecular weight (Mw) of resin components separated from the resin dispersion 1 is 52° C. and 120,000, respectively.

(Preparation of Aqueous Medium 1)

An aqueous medium 1 is prepared by uniformly mixing and dissolving 800 parts of ion-exchange water, 200 parts of the resin dispersion 1, and 70 parts of DKS-NL-450 (from Dai-ichi Kogyo Seiyaku Co., Ltd.).

(Preparation of Polyester 1 (Resin (b))

A reaction vessel equipped with a condenser, a stirrer, and a nitrogen inlet pipe is charged with 700 parts of ethylene oxide 2 mol adduct of bisphenol A and 300 parts of terephthalic acid. The mixture is subjected to a condensation reaction for 10 hours at 210° C. under normal pressures and nitrogen gas flow. The mixture is further subjected to a reaction for 5 hours while removing water under reduced pressures of 10 to 15 mmHg, followed by cooling. Thus, polyester 1, which corresponds to the resin (b), is prepared.

The polyester 1 has a weight average molecular weight (Mw) of 3,700, an acid value of 10 mgKOH/g, a hydroxyl value of 50 mgKOH/g, and a glass transition temperature (Tg) of 41° C.

(Preparation of Polyester Prepolymer 1)

A reaction vessel equipped with a condenser, a stirrer, and a nitrogen inlet pipe is charged with 680 parts of ethylene oxide 2 mol adduct of bisphenol A, 80 parts of propylene oxide 2 mol adduct of bisphenol A, 282 parts of terephthalic acid, 22 parts of trimellitic anhydride, and 2 parts of dibutyltin oxide. The mixture is subjected to a reaction for 7 hours at 230° C. under normal pressures and subsequently for 5 hours under reduced pressures of 10 to 15 mmHg. Thus, an intermediate polyester 1 is prepared.

The intermediate polyester 1 has a number average molecular weight (Mn) of 2,300, a weight average molecular weight (Mw) of 9,900, a peak molecular weight of 3,100, an acid value of 0.4 mgKOH/g, a hydroxyl value of 51 mgKOH/g, and a glass transition temperature (Tg) of 55° C.

Another reaction vessel equipped with a condenser, a stirrer, and a nitrogen inlet pipe is charged with 395 parts of the intermediate polyester 1, 91 parts of isophorone diisocyanate, and 55 parts of ethyl acetate. The mixture is subjected to a reaction for 6 hours at 100° C. Thus, a polyester prepolymer 1 is prepared. The polyester prepolymer 1 contains free isocyanates in an amount of 1.47% by weight.

(Preparation of Ketimine Compound 1)

A reaction vessel equipped with a stirrer and a thermometer is charged with 30 parts of isophoronediamine and 70 parts of methyl ethyl ketone. The mixture is subjected to a reaction for 5 hours at 50° C. Thus, a ketimine compound 1 having an amine value of 423 mgKOH/g is prepared.

(Preparation of Resins (a-1) to (a-13))

An autoclave reaction vessel equipped with a thermometer, a stirrer, and a nitrogen inlet pipe is charged with raw materials as described in Table 1 and 1 part of titanium terephthalate. After replacing the air in the reaction vessel with nitrogen, the mixture is subjected to a ring-opening polymerization for 10 hours at 160° C. under normal pressures. The mixture is further subjected to a reaction at 130° C. under normal pressures. The resulting resin is cooled to room temperature and pulverized into particles. Thus, resins (a-1) to (a-13) having a polyhydroxycarboxylic acid skeleton are prepared.

TABLE 1

| | Raw Materials (parts) | | | |
|---|---|---|---|---|
| Resin (a) No. | L-lactide | D-lactide | 1,3-propanediol | ε-caprolactone |
| a-1 | 90 | 10 | 0 | 5 |
| a-2 | 80 | 20 | 5 | 0 |
| a-3 | 65 | 35 | 0 | 5 |
| a-4 | 65 | 35 | 5 | 0 |
| a-5 | 60 | 40 | 0 | 5 |
| a-6 | 70 | 30 | 5 | 0 |
| a-7 | 70 | 30 | 0 | 5 |
| a-8 | 100 | 0 | 0 | 5 |
| a-9 | 100 | 0 | 5 | 0 |
| a-10 | 70 | 30 | 0 | 1 |
| a-11 | 70 | 30 | 1 | 0 |
| a-12 | 80 | 20 | 0 | 5 |
| a-13 | 80 | 20 | 5 | 0 |

(Preparation of Toner Components Liquids 1 to 13)

A vessel equipped with a stirrer is charged with each of the resins (a-1) to (a-13) and the polyester 1 in amounts described in Table 2, and 100 parts of ethyl acetate. When preparing colored toners, any of a cyan pigment (C. I. Pigment Blue 15:3), a magenta pigment (C. I. Pigment Red 122), a yellow pigment (C. I. Pigment Yellow 180), and a black pigment (carbon black) in an amount described in Table 2 is further added to the vessel. The mixture is agitated for 20 hours at a peripheral speed of 20 m/min to prepare a resin solution. Subsequently, the polyester prepolymer 1 in an amount described in Table 2 and 5 parts of a carnauba wax (having a molecular weight of 1,700, an acid value of 2.8 mgKOH/g, and a penetration of 1.6 mm at 50° C.) are added to the resin solution, and the mixture is subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Further, the ketimine compound 1 in an amount described in Table 2 are added.

Thus, toner components liquids 1 to 13 are prepared. The toner components liquids 1 to 13 are raw materials for toner sets 1 to 13, respectively, to be described later.

TABLE 2

| Toner Components | Composition of Toner Components Liquid | | | | | |
|---|---|---|---|---|---|---|
| | Resin (a) | | Polyester 1 | Pigment | Polyester Prepolymer | Ketimine Compound |
| Liquid No. | No. | parts | (parts) | (parts) | 1 (parts) | 1 (parts) |
| 1 | a-1 | 125.4 | 47.8 | 16.0 | 23.9 | 3.0 |
| 2 | a-2 | 133.3 | 38.1 | 16.0 | 25.4 | 3.2 |
| 3 | a-3 | 133.3 | 38.1 | 16.0 | 25.4 | 3.2 |
| 4 | a-4 | 142.4 | 27.1 | 16.0 | 27.1 | 3.4 |
| 5 | a-5 | 133.3 | 38.1 | 16.0 | 25.4 | 3.2 |
| 6 | a-6 | 133.3 | 38.1 | 16.0 | 25.4 | 3.2 |
| 7 | a-7 | 133.3 | 38.1 | 16.0 | 25.4 | 3.2 |
| 8 | a-8 | 164.7 | 0.0 | 16.0 | 31.4 | 3.9 |
| 9 | a-9 | 186.7 | 0.0 | 16.0 | 8.9 | 4.4 |
| 10 | a-10 | 13.4 | 159.6 | 16.0 | 26.6 | 0.3 |
| 11 | a-11 | 186.2 | 0.0 | 16.0 | 9.2 | 4.6 |
| 12 | a-12 | 133.3 | 38.1 | 16.0 | 25.4 | 3.2 |
| 13 | a-13 | 133.3 | 38.1 | 16.0 | 25.4 | 3.2 |

(Preparation of Mother Toner Sets 1 to 13)

A vessel is charged with 150 parts of the aqueous medium 1, and 100 parts of each of the toner components liquid are added thereto while the aqueous medium is agitated at a revolution of 12,000 rpm using T. K. HOMOMIXER (from PRIMIX Corporation). The mixture is agitated for 10 minutes. Thus, an emulsion slurry is prepared.

A conical flask equipped with a stirrer and thermometer is charged with 100 parts of the emulsion slurry. The emulsion slurry is subjected to a solvent removal for 12 hours at 30° C. while being agitated at a peripheral speed of 20 m/min. Thus, a dispersion slurry is prepared.

Next, 100 parts of the dispersion slurry is filtered under reduced pressures to obtain a wet cake. The wet cake is mixed with 100 parts of ion-exchange water and the mixture is agitated for 10 minutes at a revolution of 12,000 rpm using T. K. HOMOMIXER (from PRIMIX Corporation), followed by filtering. Thus, a wet cake (i) is prepared.

The wet cake (i) is mixed with 300 parts of ion-exchange water and the mixture is agitated for 10 minutes at a revolution of 12,000 rpm using the T. K. HOMOMIXER, followed by filtering. This operation is repeated twice. Thus, a wet cake (ii) is prepared.

The wet cake (ii) is mixed with 20 parts of a 10% aqueous solution of sodium hydroxide and the mixture is agitated for 30 minutes at a revolution of 12,000 rpm using the T. K. HOMOMIXER, followed by filtering under reduced pressures. Thus, a wet cake (iii) is prepared.

The wet cake (iii) is mixed with 300 parts of ion-exchange water and the mixture is agitated for 10 minutes at a revolution of 12,000 rpm using the T. K. HOMOMIXER, followed by filtering. Thus, a wet cake (iv) is prepared.

The wet cake (iv) is mixed with 300 parts of ion-exchange water and the mixture is agitated for 10 minutes at a revolution of 12,000 rpm using the T. K. HOMOMIXER, followed by filtering. This operation is repeated twice. Thus, a wet cake (v) is prepared.

The wet cake (v) is mixed with 20 parts of a 10% hydrochloric acid and the mixture is agitated for 10 minutes at a revolution of 12,000 rpm using the T. K. HOMOMIXER. Further, a 5% methanol solution of a fluorine-containing quaternary ammonium salt FTERGENT F-310 (from Neos Company Limited) is added so that the fluorine-containing quaternary ammonium salt is included in an amount of 0.1 parts based on 100 parts of solid components of the toner, and the mixture is agitated for 10 minutes, followed by filtering. Thus, a wet cake (vi) is prepared.

The wet cake (vi) is mixed with 300 parts of ion-exchange water and the mixture is agitated for 10 minutes at a revolution of 12,000 rpm using the T. K. HOMOMIXER, followed by filtering. This operation is repeated twice. Thus, a wet cake (vii) is prepared.

The wet cake (vii) is dried for 36 hours at 40° C. using a circulating air drier, followed by sieving with a screen having openings of 75 μm.

Thus, mother toner sets 1 to 13 each including a cyan mother toner, a magenta mother toner, a yellow mother toner, a black mother toner, and a transparent mother toner are prepared. With regard to the mother toner set 13, not fine particles but aggregations of the resins are obtained because the resulting resin is in gel state.

(Preparation of Toner Sets 1 to 13)

First, 100 parts of each toner of the mother toner sets 1 to 13 and 1.0 part of a hydrophobized silica (H2000 from Clariant Japan K.K.) serving as an external additive are mixed using a HENSCHEL MIXER (from Mitsui Mining Co., Ltd.) for 30 seconds at a peripheral speed of 30 m/sec, followed by a pause for 1 minute. This mixing treatment is repeated 5 times. The mother toner thus mixed with the hydrophobized silica is sieved with a mesh having openings of 35 μm.

Thus, toner sets 1 to 13 respectively corresponding to Examples 1 to 7 and Comparative Examples 1 to 6 are prepared. With regard to the toner set 13, fine particles are not obtained, and therefore image cannot be obtained.

The optical purity X (%), weight ratio, and weight average molecular weight of the polyhydroxycarboxylic acid skeleton in the resin (a) are shown in Table 3.

TABLE 3

| | Toner Set No. | Polyhydroxycarboxylic Acid Skeleton: Optical Purity X = \|L-D\| (%) | Weight Ratio (%) | Weight Average Molecular Weight (Mw) |
|---|---|---|---|---|
| Example 1 | 1 | 80 | 59.7 | 9,000 |
| Example 2 | 2 | 60 | 63.5 | 25,000 |
| Example 3 | 3 | 30 | 63.5 | 47,000 |
| Example 4 | 4 | 30 | 67.8 | 60,000 |
| Example 5 | 5 | 20 | 63.5 | 46,000 |
| Example 6 | 6 | 40 | 63.5 | 32,000 |
| Example 7 | 7 | 40 | 63.5 | 14,000 |
| Comparative Example 1 | 8 | 100 | 78.4 | 26,000 |
| Comparative Example 2 | 9 | 100 | 88.9 | 13,000 |
| Comparative Example 3 | 10 | 40 | 6.7 | 15,000 |
| Comparative Example 4 | 11 | 40 | 92.2 | 20,000 |
| Comparative Example 5 | 12 | 60 | 63.5 | 4,000 |
| Comparative Example 6 | 13 | 60 | 63.5 | 102,000 |

Examples 8 and 9

Preparation of Toner Sets 14 and 15

The procedures for preparation of the toner sets 1 and 2 are repeated except that the toner components liquids 1 and 2, respectively, are mixed with 3 parts of a layered inorganic mineral montmorillonite which is partially or completely modified with a quaternary ammonium salt having benzyl group (CLAYTONE®APA from Southern Clay Products, Inc.) for 30 minutes using a T. K. HOMODISPER (from PRIMIX Corporation). Thus, toner sets 14 and 15 are prepared, respectively.

Examples 10 and 11

Preparation of Toner Sets 16 and 17

The procedure for preparation of the toner set 3 is repeated except that the amount of the resin (a-3) is changed to 155.6 parts, the amount of the polyester 1 is changed to 44.4 parts, and the polyester prepolymer 1 and the ketimine compound 1 are not added. Thus, a toner set 16 is prepared.

The procedure for preparation of the toner set 4 is repeated except that the amount of the resin (a-4) is changed to 168.0 parts, the amount of the polyester 1 is changed to 32.0 parts, and the polyester prepolymer 1 and the ketimine compound 1 are not added. Thus, a toner set 17 is prepared.

Examples 12 and 13

Preparation of Resin Dispersion 2

In an autoclave, a mixture of 1,325 g of terephthalic acid, 85 g of isophthalic acid, 360 g of ethylene glycol, and 710 g of neopentyl glycol is subjected to an esterification reaction for 4 hours at 250° C.

Next, 0.244 g of a germanium dioxide are added as a catalyst and the reacting system is heated to 280° C. over a period of 30 minutes. The pressure of the reacting system is gradually reduced to 0.1 Torr over a period of 1 hour. The mixture is then further subjected to a polycondensation reaction for 1.5 hours. The pressure of the reacting system is returned to normal pressure with nitrogen gas and the temperature thereof is reduced. At the time the temperature becomes 260° C., 50 g of isophthalic acid and 32 g of trimellitic anhydride are further added and agitated for 30 minutes at 250° C. The resultant resin is taken out in the form of sheet.

The sheet is satisfactorily cooled to room temperature and pulverized using a crasher, followed by sieving with a mesh having openings of 1 to 6 mm. Thus, a polyester resin is prepared.

A 2-liter glass container equipped with a jacket is charged with 200 g of the polyester resin, 35 g of ethylene glycol n-butyl ether, 459 g of a 0.5% aqueous solution of a polyvinyl alcohol (UNITIKA POVAL 050G from Unitika Ltd., hereinafter "PVA-1"), and N,N-dimethylethanolamine in an amount of 1.2 times equivalence to the total amount of carboxyl groups in the polyester resin. The mixture is agitated using a T. K. ROBOMIX (from PRIMIX Corporation) at a revolution of 6,000 rpm in an open system. As a result, resin particles do not become precipitated but are in suspension. After being left at rest for 10 minutes, the resultant suspension starts to be heated by introducing hot water into the jacket. When the temperature in the container reaches 68° C., the revolution is changed to 7,000 rpm. The suspension is further agitated for 20 minutes at 68 to 70° C. Thus, a milky aqueous dispersion is prepared.

Next, cold water is introduced into the jacket to cool the suspension to room temperature while agitating the suspension at a revolution of 3,500 rpm, followed by filtering with a plain-wave stainless steel filter with 635 mesh. Thus, a resin dispersion 2 is prepared.

(Preparation of Toner Sets 18 and 19)

The procedures for preparation of the toner sets 5 and 6 are repeated for replacing the resin dispersion 1 with the resin dispersion 2. Thus, toner sets 18 and 19 are prepared, respectively.

The optical purity X (%), weight ratio, and weight average molecular weight of the polyhydroxycarboxylic acid skeleton in the resin (a) are shown in Table 4.

TABLE 4

| | Toner Set No. | Polyhydroxycarboxylic Acid Skeleton: Optical Purity X = \|L-D\| (%) | Weight Ratio (%) | Weight Average Molecular Weight (Mw) |
|---|---|---|---|---|
| Example 8 | 14 | 80 | 59.7 | 9,000 |
| Example 9 | 15 | 60 | 63.5 | 25,000 |
| Example 10 | 16 | 30 | 74.1 | 47,000 |
| Example 11 | 17 | 30 | 80.0 | 60,000 |
| Example 12 | 18 | 20 | 63.5 | 46,000 |
| Example 13 | 19 | 40 | 63.5 | 32,000 |

Preparation of Carrier

To prepare a resin layer coating liquid, 100 parts of a silicone resin (organo straight silicone), 5 parts of γ-(2-aminoethyl)aminopropyl trimethoxysilane, and 10 parts of a carbon black are mixed with 100 parts of toluene for 20 minutes using a HOMOMIXER. The resin layer coating liquid is applied to the surfaces of 1,000 parts of spherical magnetite particles having a volume average particle diameter of 50 μm using a fluidized bed-type coating applicator. Thus, a carrier is prepared.

Preparation of Developer Sets

Each of the toners in the toner sets 1 to 19 in an amount of 5 parts is mixed with the carrier in an amount of 95 parts. Thus, developer sets 1 to 19 are prepared.

Evaluations

The developer sets 1 to 19 are subjected to the following evaluations.

1) Hot Offset Resistance

In a first tandem full-color image forming apparatus IMAGIO MP C7500 (from Ricoh Co., Ltd.), cyan, magenta, yellow, and black solid toner images each being square with each side having a length of 5 cm are formed on a copying paper TYPE 6000 <70W> (from Ricoh Co., Ltd.). In a second tandem full-color image forming apparatus IMAGIO MP C7500 (from Ricoh Co., Ltd.), a transparent toner is superimposed on the cyan, magenta, yellow, and black solid toner images. The cyan, magenta, yellow, and black solid toner images having the transparent toner thereon are fixed on the paper while varying the fixing temperature.

The image forming apparatuses have been previously adjusted so that the deposition amount of each of the cyan, magenta, yellow, black, and transparent toners becomes 1.40±0.05 m/cm$^2$. Hot offset resistance is evaluated with the maximum fixable temperature which is defined as a temperature above which hot offset occurs. The results are graded into 4 levels as follows. A, B, and C are practicable.

A: The maximum fixable temperature is 190° C. or more.

B: The maximum fixable temperature is 180° C. or more and less than 190° C.

C: The maximum fixable temperature is 170° C. or more and less than 180° C.

D: The maximum fixable temperature is less than 170° C.

2) Gloss Uniformity

Cyan dot images with 600 dpi being square with each side having a length of 5 cm in which dots are occupying 0%, 25%, 50%, 75%, and 100% of the image area are formed using the above-described first tandem full-color image forming apparatus. A transparent toner in an amount of 1.40±0.05 m/cm$^2$ is superimposed on each of the cyan dot images, and the cyan dot images having the transparent toner thereon are fixed on the paper in a similar way to the evaluation 1). The fixed cyan dot images having the transparent toner thereon are subjected to a measurement of gloss using a gloss meter VGS-1D (from Nippon Denshoku Industries Co., Ltd.). Gloss uniformity is evaluated with the absolute value of the difference between the maximum gloss and the minimum gloss, which is represented by ΔK(Cyan). The results are graded into 4 levels as follows. A, B, and C are practicable.

A: ΔK(Cyan) is less than 10%.

B: ΔK(Cyan) is 10% or more and less than 20%.

C: ΔK(Cyan) is 20% or more and less than 30%.

D: ΔK(Cyan) is 30% or more.

3) Color Reproducibility

Secondary color images comprised of primary-color toners of yellow, magenta, and cyan are formed and a transparent toner is superimposed and fixed thereon in a similar way to the evaluation 1). Color reproducibility is determined by visually observing the produced images. The results are graded into 4 levels as follows. A, B, and C are practicable.

A: Very good

B: Good

C: Acceptable

D: Poor

4) Abrasion Resistance

In the first tandem full-color image forming apparatus IMAGIO MP C7500 (from Ricoh Co., Ltd.), cyan, magenta, yellow, and black solid toner images each being square with each side having a length of 5 cm are formed on an OHP sheet TYPE PPC-DX (from Ricoh Co., Ltd.). In the second tandem full-color image forming apparatus IMAGIO MP C7500 (from Ricoh Co., Ltd.), a transparent toner is superimposed on the cyan, magenta, yellow, and black solid toner images. The cyan, magenta, yellow, and black solid toner images having the transparent toner thereon are fixed on the OHP sheet while setting the fixing temperature to 160° C.

The image forming apparatuses have been previously adjusted so that the deposition amount of each of the cyan, magenta, yellow, black, and transparent toners becomes 1.40±0.05 m/cm$^2$. The solid images having the transparent toner thereon are subjected to a measurement of haze, and subsequently abraded with a sandpaper No. 2000 for 3 times. The abraded solid images are subjected to a measurement of haze again. The change in haze before and after the abrasion with the sandpaper No. 2000 is calculated. Abrasion resistance is evaluated with the average of the change in haze among 4 colors. The results are graded into 4 levels as follows. A and B are practicable.

A: Average haze increase is less than 10%.

B: Average haze increase is 10% or more and less than 30%.

C: Average haze increase is 30% or more.

Generally, haze represents transparency of toner. The lower the haze, the higher the transparency. Highly transparent toners can exhibit bright colors. When abrasion resistance of an image is poor, haze generally increases after the image is abraded.

The evaluation results are shown in Table 5.

TABLE 5

| | | Evaluations | | | |
|---|---|---|---|---|---|
| | Toner Set No. | Hot Offset Resistance | Gloss Uniformity | Color Reproducibility | Abrasion Resistance |
| Ex. 1 | 1 | B | B | B | B |
| Ex. 2 | 2 | B | B | B | A |
| Ex. 3 | 3 | A | A | A | A |
| Ex. 4 | 4 | A | A | A | A |
| Ex. 5 | 5 | A | A | A | A |
| Ex. 6 | 6 | B | A | A | A |
| Ex. 7 | 7 | B | B | A | A |
| Ex. 8 | 14 | B | B | B | B |
| Ex. 9 | 15 | B | B | B | A |
| Ex. 10 | 16 | A | A | A | A |
| Ex. 11 | 17 | A | A | A | A |
| Ex. 12 | 18 | B | A | A | A |
| Ex. 13 | 19 | B | A | A | A |
| Comp. Ex. 1 | 8 | C | D | D | B |
| Comp. Ex. 2 | 9 | D | D | D | B |
| Comp. Ex. 3 | 10 | C | C | C | C |
| Comp. Ex. 4 | 11 | B | D | C | B |
| Comp. Ex. 5 | 12 | D | C | C | C |
| Comp. Ex. 6 | 13 | — | — | — | — |

It is apparent from Table 5 that the toner sets 1 to 7 produce good results in the evaluation of hot offset resistance, gloss uniformity, color reproducibility, and abrasion resistance because the toners include a resin having a polyhydroxycarboxylic acid skeleton comprised of L-isomer and L-isomer at an appropriate ratio. The toner sets 8 and 9 produce poor results in the evaluation of gloss uniformity and color reproducibility because the ratio between L-isomer and D-isomer is not appropriate. The toner set 10 produces poor results in the evaluation of abrasion resistance because the content of the resin having a polyhydroxycarboxylic acid skeleton is too small. The toner set 11 produces poor results in the evaluation of gloss uniformity because the content of the resin having a polyhydroxycarboxylic acid skeleton is too large. The toner set 12 produces poor results in the evaluation of hot offset resistance because the molecular weight of the polyhydroxycarboxylic acid skeleton is too small. With regard to the toner set 13, toner particles cannot be formed in an aqueous medium because the molecular weight of the polyhydroxycarboxylic acid skeleton is too large. With regard to the toner sets 14 and 15 in which a layered inorganic mineral is added, evaluation results are similar to those without layered inorganic mineral but the ease of image forming is better because chargeability is more stabilized by addition of the layered inorganic mineral. Although no prepolymer is added, the toner sets 16 and 17 also produce good results because the resin having the polyhydroxycarboxylic acid skeleton has enough molecular weight to exhibit good hot offset resistance. Additionally, the toner sets 16 and 17 exhibit high transparency because of including only one kind of resin. The toner sets 18 and 19 are prepared using a polyester-based particulate resin dispersion, which does not adversely affect the image quality but advantageously reduces the minimum fixable temperature.

Examples 14 to 17

Comparative Examples 7 to 11

Preparation of Resin Dispersion 3

A reaction vessel equipped with a stirrer and a thermometer is charged with 705 parts of water, 17 parts of a sodium salt of sulfate of ethylene oxide adduct of methacrylic acid (ELEMINOL RS-30 from Sanyo Chemical Industries, Ltd.), 84 parts of styrene, 84 parts of methacrylic acid, 112 parts of butyl acrylate, and 3 parts of ammonium persulfate. The mixture is agitated for 1 hour at a revolution of 4,200 rpm. Thus, a whitish emulsion is prepared. Subsequently, the reaction system is heated to 75° C. and the mixture is subjected to a reaction for 4 hours. After adding 45 parts of a 1% by weight aqueous solution of ammonium persulfate, the mixture is subjected to aging for 6 hours at 75° C. Thus, a resin dispersion 3 is prepared.

The volume average particle diameter of the resin dispersion 3 measured by a Particle Size Distribution Analyzer LA-920 (from Horiba, Ltd.) is 50 nm. The glass transition temperature (Tg) and the weight average molecular weight (Mw) of resin components separated from the resin dispersion 3 is 52° C. and 120,000, respectively.

(Preparation of Aqueous Medium 2)

An aqueous medium 2 is prepared by uniformly mixing and dissolving 800 parts of ion-exchange water, 200 parts of the resin dispersion 3, and 70 parts of DKS-NL-450 (from Dai-ichi Kogyo Seiyaku Co., Ltd.).

(Preparation of Polyester 2 (Resin (b))

A reaction vessel equipped with a condenser, a stirrer, and a nitrogen inlet pipe is charged with 720 parts of ethylene oxide 2 mol adduct of bisphenol A and 310 parts of terephthalic acid. The mixture is subjected to a condensation reaction for 10 hours at 210° C. under normal pressures and nitrogen gas flow. The mixture is further subjected to a reaction for 5 hours while removing water under reduced pressures of 10 to 15 mmHg, followed by cooling. Thus, polyester 2, which corresponds to the resin (b), is prepared.

The polyester 2 has a weight average molecular weight (Mw) of 3,900, an acid value of 10 mgKOH/g, a hydroxyl value of 50 mgKOH/g, and a glass transition temperature (Tg) of 43° C.

(Preparation of Resins (a-14) to (a-22))

An autoclave reaction vessel equipped with a thermometer, a stirrer, and a nitrogen inlet pipe is charged with raw materials as described in Table 6 and 1 part of titanium terephthalate. After replacing the air in the reaction vessel with nitrogen, the mixture is subjected to a ring-opening polymerization for 10 hours at 160° C. under normal pressures. The mixture is further subjected to a reaction at 130° C. under normal pressures. The resulting resin is cooled to room temperature and pulverized into particles. Thus, resins (a-14) to (a-22) having a polyhydroxycarboxylic acid skeleton are prepared.

TABLE 6

| | Raw Materials (parts) | | |
|---|---|---|---|
| Resin (a) No. | L-lactide | D-lactide | ϵ-caprolactone |
| a-14 | 85 | 15 | 5 |
| a-15 | 75 | 25 | 6 |
| a-16 | 65 | 35 | 4 |
| a-17 | 55 | 45 | 6 |
| a-18 | 95 | 5 | 3 |
| a-19 | 85 | 15 | 2 |
| a-20 | 70 | 30 | 4 |
| a-21 | 70 | 30 | 2 |
| a-22 | 80 | 20 | 7 |

(Preparation of Toner Components Liquids 14 to 22)

A vessel equipped with a stirrer is charged with each of the resins (a-14) to (a-22) and the polyester 2 in amounts described in Table 7, and 100 parts of ethyl acetate. The mixture is agitated for 20 hours at a peripheral speed of 20 m/min to prepare a resin solution. Subsequently, 5 parts of a carnauba wax (having a molecular weight of 1,800, an acid value of 2.6 mgKOH/g, and a penetration of 1.7 mm at 40° C.) are added to the resin solution, and the mixture is subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Thus, toner components liquids 14 to 22 are prepared. The toner components liquids 14 to 22 are raw materials for transparent toners 20 to 28, respectively, to be described later.

TABLE 7

| Toner | Composition of Toner Components Liquid | | |
|---|---|---|---|
| Components | Resin (a) | | Polyester 2 |
| Liquid No. | No. | parts | (parts) |
| 14 | a-14 | 155.6 | 44.4 |
| 15 | a-15 | 155.9 | 44.1 |
| 16 | a-16 | 182.5 | 17.4 |
| 17 | a-17 | 35.0 | 165.0 |
| 18 | a-18 | 134.6 | 65.4 |
| 19 | a-19 | 200.0 | 0.0 |
| 20 | a-20 | 18.8 | 181.2 |
| 21 | a-21 | 67.5 | 132.5 |
| 22 | a-22 | 156.2 | 43.8 |

(Preparation of Mother Transparent Toners 20 to 28)

A vessel is charged with 150 parts of the aqueous medium 2, and 100 parts of each of the toner components liquid are added thereto while the aqueous medium is agitated at a revolution of 12,000 rpm using T. K. HOMOMIXER (from PRIMIX Corporation). The mixture is agitated for 10 minutes. Thus, an emulsion slurry is prepared.

A conical flask equipped with a stirrer and thermometer is charged with 100 parts of the emulsion slurry. The emulsion slurry is subjected to a solvent removal for 12 hours at 30° C. while being agitated at a peripheral speed of 20 m/min. Thus, a dispersion slurry is prepared.

Next, 100 parts of the dispersion slurry is filtered under reduced pressures to obtain a wet cake. The wet cake is mixed with 100 parts of ion-exchange water and the mixture is agitated for 10 minutes at a revolution of 12,000 rpm using T. K. HOMOMIXER (from PRIMIX Corporation), followed by filtering. Thus, a wet cake (i) is prepared.

The wet cake (i) is mixed with 300 parts of ion-exchange water and the mixture is agitated for 10 minutes at a revolution of 12,000 rpm using the T. K. HOMOMIXER, followed by filtering. This operation is repeated twice. Thus, a wet cake (ii) is prepared.

The wet cake (ii) is mixed with 20 parts of a 10% aqueous solution of sodium hydroxide and the mixture is agitated for 30 minutes at a revolution of 12,000 rpm using the T. K. HOMOMIXER, followed by filtering under reduced pressures. Thus, a wet cake (iii) is prepared.

The wet cake (iii) is mixed with 300 parts of ion-exchange water and the mixture is agitated for 10 minutes at a revolution of 12,000 rpm using the T. K. HOMOMIXER, followed by filtering. This operation is repeated twice. Thus, a wet cake (iv) is prepared.

The wet cake (iv) is mixed with 20 parts of a 10% hydrochloric acid and the mixture is agitated for 10 minutes at a revolution of 12,000 rpm using the T. K. HOMOMIXER. Further, a 5% methanol solution of a fluorine-containing quaternary ammonium salt FTERGENT F-310 (from Neos Company Limited) is added so that the fluorine-containing quaternary ammonium salt is included in an amount of 0.1 parts based on 100 parts of solid components of the toner, and the mixture is agitated for 10 minutes, followed by filtering. Thus, a wet cake (v) is prepared.

The wet cake (v) is mixed with 300 parts of ion-exchange water and the mixture is agitated for 10 minutes at a revolution of 12,000 rpm using the T. K. HOMOMIXER, followed by filtering. This operation is repeated twice. Thus, a wet cake (vi) is prepared.

The wet cake (vi) is dried for 36 hours at 40° C. using a circulating air drier, followed by sieving with a screen having openings of 75 μm. Thus, mother transparent toners 20 to 28 are prepared.

(Preparation of Transparent Toners 20 to 28)

First, 100 parts of each of the mother transparent toners 20 to 28 and 1.0 part of a hydrophobized silica (H2000 from Clariant Japan K.K.) serving as an external additive are mixed using a HENSCHEL MIXER (from Mitsui Mining Co., Ltd.) for 30 seconds at a peripheral speed of 30 m/sec, followed by a pause for 1 minute. This mixing treatment is repeated 5 times. The mother toner thus mixed with the hydrophobized silica is sieved with a mesh having openings of 35 μm. Thus, transparent toners 20 to 28 respectively corresponding to Examples 14 to 17 and Comparative Examples 7 to 11 are prepared.

Comparative Examples 12 and 13

Preparation of Transparent Toner 29

First, 100 parts of the polyester 2 (i.e., resin (b)), 1 part of a charge controlling agent E-84 (from Orient Chemical Industries Co., Ltd.), and 5 parts of an ester wax (having an acid value of 5 mgKOH/g and a weight average molecular weight of 1,600) are preliminarily mixed using a HENSCHEL MIXER FM10B (from Mitsui Mining Co., Ltd.). The mixture is kneaded using a TWIN SCREW EXTRUDER PCM-30 (from Ikegai Co., Ltd.). The kneaded mixture is pulverized into fine particles using an ultrasonic jet pulverizer (from Nippon Pneumatic Mfg. Co., Ltd.). The fine particles are classified using an airflow classifier MDS-I (from Nippon Pneumatic Mfg. Co., Ltd.). Thus, a mother transparent toner 29 having a weight average particle diameter of 8 μm is prepared.

Next, 100 parts of the mother transparent toner 29 and 1.0 part of a colloidal silica (H-2000 from Clariant Japan K.K.) using a sample mill. Thus, a transparent toner 29 is prepared.

(Preparation of Transparent Toner 30)

The procedure for preparation of the transparent toner 29 is repeated except for replacing the polyester 2 with an ionomer resin (HIMILAN® Du Pont-Mitsui Polychemicals Co., Ltd.). Thus, a transparent toner 30 is prepared.

Examples 18 and 19

Preparation of Transparent Toners 31 and 32

The procedures for preparation of the transparent toners 20 and 21 are repeated except that the toner components liquids 14 and 15, respectively, are mixed with 3 parts of a layered inorganic mineral montmorillonite which is partially or completely modified with a quaternary ammonium salt having benzyl group (CLAYTONE® APA from Southern Clay Products, Inc.) for 30 minutes using a T. K. HOMODISPER (from PRIMIX Corporation). Thus, transparent toners 31 and 32 are prepared, respectively.

Examples 20 and 21

Preparation of Transparent Toners 33 and 34

The procedures for preparation of the transparent toners 22 and 23 are repeated except that the resin dispersion 3 is replaced with the resin dispersion 2. Thus, transparent toners 33 and 34 are prepared, respectively.

The optical purity X (%), weight ratio, and weight average molecular weight of the polyhydroxycarboxylic acid skeleton in the resin (a) are shown in Table 8.

TABLE 8

| | | Polyhydroxycarboxylic Acid Skeleton | | |
|---|---|---|---|---|
| | Transparent Toner No. | Optical Purity X = \|L-D\| (%) | Weight Ratio (%) | Weight Average Molecular Weight (Mw) |
| Ex. 14 | 20 | 70 | 74.1 | 8,000 |
| Ex. 15 | 21 | 50 | 73.5 | 21,000 |
| Ex. 16 | 22 | 30 | 87.7 | 15,000 |
| Ex. 17 | 23 | 10 | 16.5 | 55,000 |
| Ex. 18 | 31 | 70 | 74.1 | 8,000 |
| Ex. 19 | 32 | 50 | 73.5 | 21,000 |
| Ex. 20 | 33 | 30 | 87.7 | 15,000 |
| Ex. 21 | 34 | 10 | 16.5 | 55,000 |
| Comp. Ex. 7 | 24 | 90 | 65.4 | 9,000 |
| Comp. Ex. 8 | 25 | 70 | 98.0 | 8,000 |
| Comp. Ex. 9 | 26 | 40 | 9.1 | 15,000 |

TABLE 8-continued

| | Transparent Toner No. | Polyhydroxycarboxylic Acid Skeleton | | |
|---|---|---|---|---|
| | | Optical Purity X = \|L-D\| (%) | Weight Ratio (%) | Weight Average Molecular Weight (Mw) |
| Comp. Ex. 10 | 27 | 40 | 33.1 | 5,000 |
| Comp. Ex. 11 | 28 | 60 | 73.0 | 80,000 |
| Comp. Ex. 12 | 29 | — | — | — |
| Comp. Ex. 13 | 30 | — | — | — |

Preparation of Developer

Each of the transparent toners 20 to 34 in an amount of 5 parts is mixed with the above-prepared carrier in an amount of 95 parts. Thus, developers 20 to 34 corresponding to Examples 14 to 21 and Comparative Examples 7 to 13 are prepared.

As described below, the transparent toners 20 to 34 are directly subjected to the evaluation of temporal change of charge amount. The developers 20 to 34 are brought to formation of images in conjunction with an ink-jet printer to evaluate hot offset resistance, gloss, and abrasion resistances as described below.

Comparative Example 14

An image formed by an ink-jet printer is subjected to the evaluation of gloss as described below.

Evaluations

5) Temporal Change in Charge Amount

Each of the transparent toners 20 to 34 in an amount of 0.6 g and a silicone ferrite carrier having an average particle diameter of 90 μm (from Kanto Denka Kogyo Co., Ltd.) in an amount of 19.4 g are contained in a 50-ml plastic bottle. The plastic bottle is subjected to a ball mill treatment for 60 seconds at 250 rpm and subsequently an initial charge amount of the toner is measured using a q/m meter (from EPPING Pes-Laboratorium). The plastic bottle is then shaken for 300 times and subsequently a temporal charge amount of the toner is measured using the q/m meter. The degree of temporal change in charge amount is determined by the ratio (T/I) of the temporal charge amount to the initial charge amount and graded into 4 levels as follows. A and B are practicable.

A: T/I is 80% or more.

B: T/I is 60% or more and less than 80%.

C: T/I is 40% or more and less than 60%.

C: T/I is less than 40%.

6) Hot Offset Resistance

Cyan, magenta, yellow, and black solid ink images each being square with each side having a length of 5 cm are formed on a copying paper TYPE 6000 <70W> (from Ricoh Co., Ltd.) using an ink-jet printer GX3000 (from Ricoh Cp., Ltd.). Each of the transparent developers 20 to 34 is set in the first station of a tandem full-color image forming apparatus IMAGIO NEO 450 (from Ricoh Co., Ltd.) while no toner is set in the other 3 stations. The transparent toner is superimposed on the cyan, magenta, yellow, and black solid ink images in the image forming apparatus while varying the fixing temperature.

The image forming apparatus has been previously adjusted so that the deposition amount of the transparent toner becomes 1.40±0.05 m/cm$^2$. Hot offset resistance is evaluated with the maximum fixable temperature which is defined as a temperature above which hot offset occurs. The results are graded into 4 levels as follows. A, B, and C are practicable.

A: The maximum fixable temperature is 190° C. or more.

B: The maximum fixable temperature is 180° C. or more and less than 190° C.

C: The maximum fixable temperature is 170° C. or more and less than 180° C.

D: The maximum fixable temperature is less than 170° C.

7) Gloss

Cyan, magenta, yellow, and black solid ink images each being square with each side having a length of 5 cm in which dots are occupying 0%, 25%, 50%, 75%, and 100% of the image area are formed on a copying paper TYPE 6000 <70W> (from Ricoh Co., Ltd.) using an ink-jet printer GX3000 (from Ricoh Cp., Ltd.). Each of the transparent developers 20 to 34 is set in the first station of a tandem full-color image forming apparatus IMAGIO NEO 450 (from Ricoh Co., Ltd.) while no toner is set in the other 3 stations. The transparent toner is superimposed on the cyan, magenta, yellow, and black ink images in the image forming apparatus while varying the fixing temperature.

The image forming apparatus has been previously adjusted so that the deposition amount of the transparent toner becomes 1.40±0.05 m/cm$^2$. The ink images having the transparent toner thereon are subjected to a measurement of gloss using a gloss meter VGS-1D (from Nippon Denshoku Industries Co., Ltd.). A difference between the average gloss among the images and the gloss of the copying paper TYPE 6000 <70W> is graded into 4 levels as follows. A and B are practicable.

A: The difference is 15% or more.

B: The difference is 5% or more and less than 15%.

C: The difference is less than 5%.

8) Abrasion Resistance

A transparent toner image being square with each side having a length of 5 cm is formed on an OHP sheet TYPE PPC-DX (from Ricoh Co., Ltd.) using the tandem full-color image forming apparatus IMAGIO NEO C450 (from Ricoh Co., Ltd.) which is used for the above evaluation 6) while setting the fixing temperature to 160° C. The image forming apparatus has been previously adjusted so that the deposition amount of each of the transparent toner becomes 1.40±0.05 m/cm$^2$. The produced transparent image is subjected to a measurement of haze, and subsequently abraded with a sandpaper No. 2000 for 3 times. The abraded transparent image is subjected to a measurement of haze again. The change in haze before and after the abrasion with the sandpaper No. 2000 is calculated. Abrasion resistance is evaluated with the change in haze. The results are graded into 4 levels as follows. A and B are practicable. The reason why the transparent toner is directly deposited on the OHP sheet is that ink-jet image cannot be formed on the OHP sheet which is unprocessed.

A: Average haze increase is less than 10%.

B: Average haze increase is 10% or more and less than 30%.

C: Average haze increase is 30% or more.

Generally, haze represents transparency of toner. The lower the haze, the higher the transparency. Highly transparent toners can exhibit bright colors. When abrasion resistance of an image is poor, haze generally increases after the image is abraded.

The evaluation results are shown in Table 9.

TABLE 9

| | Transparent Toner No. | Evaluations: Temporal Change in Charge Amount | Hot Offset Resistance | Gloss | Abrasion Resistance |
|---|---|---|---|---|---|
| Ex. 14 | 20 | A | A | A | A |
| Ex. 15 | 21 | A | A | A | A |
| Ex. 16 | 22 | A | A | A | A |
| Ex. 17 | 23 | A | A | A | A |
| Ex. 18 | 31 | A | A | A | A |
| Ex. 19 | 32 | A | A | A | A |
| Ex. 20 | 33 | A | A | A | A |
| Ex. 21 | 34 | A | A | A | A |
| Comp. Ex. 7 | 24 | B | C | B | B |
| Comp. Ex. 8 | 25 | C | B | B | A |
| Comp. Ex. 9 | 26 | A | C | A | C |
| Comp. Ex. 10 | 27 | A | D | A | B |
| Comp. Ex. 11 | 28 | C | C | B | C |
| Comp. Ex. 12 | 29 | B | B | A | C |
| Comp. Ex. 13 | 30 | D | A | A | A |
| Comp. Ex. 14 | — | — | — | C | — |

It is apparent from Tables 8 and 9 that the transparent toners of Examples 14 to 17 produce good results in the evaluations of hot offset resistance, gloss, temporal change of charge amount, and abrasion resistance because of including a resin having an appropriate polyhydroxycarboxylic acid skeleton. In Comparative Example 7, hot offset resistance is poor because the optical purity is so high that the resin exhibit strong crystallinity. In Comparative Example 8, the result in the evaluation of temporal change of charge amount is poor because the content of the polyhydroxycarboxylic acid skeleton is too high. In Comparative Example 9, hot offset resistance is poor because the content of the polyhydroxycarboxylic acid skeleton is too low. In Comparative Example 10, although the optical purity and content of the polyhydroxycarboxylic acid skeleton are appropriate, hot offset resistance is poor because the molecular weight is too low. In Comparative Example 11, although the optical purity and content of the polyhydroxycarboxylic acid skeleton are appropriate, the results in the evaluations of hot offset resistance, temporal change of charge amount, and abrasion resistance are poor because the molecular weight is too high and toner particles cannot be formed normally. It is apparent from the results of Comparative Example 12 that the transparent toner including a polyester without polyhydroxycarboxylic acid skeleton does not have sufficient abrasion resistance required for surface transparent layer even if it produces good results in the evaluations of offset resistance, gloss, and temporal change in charge amount. Ionomer resins are difficult to be applied to pulverization methods because of being very hard. Ionomer resins are also difficult to be applied to granulation methods using aqueous media because the solubility is very different from conventionally-used resins. In Comparative Example 13 using an ionomer resin, a small amount of toner particles are obtained through pulverization and classification processes. But the toner particles cannot keep constant charge, which may cause faulty operation in electrophotographic machines. In Examples 18 and 19, images are normally produced for an extended period of time because charge amount changes little with time owing to addition of a layered inorganic mineral. In Examples 20 and 21, the toners are prepared using a polyester-based particulate resin dispersion, which does not adversely affect the image quality but advantageously reduces the minimum fixable temperature.

This document claims priority and contains subject matter related to Japanese Patent Applications Nos. 2009-011739 filed on Jan. 22, 2009, 2009-098732 filed on Apr. 15, 2009, and 2009-219078 filed on Sep. 24, 2009, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a binder resin comprising a resin (a) comprising a polyhydroxycarboxylic acid skeleton formed from an optically-active monomer, wherein the polyhydroxycarboxylic acid skeleton has a weight average molecular weight of from 7,000 to 60,000, wherein the binder resin comprises the polyhydroxycarboxylic acid skeleton in an amount of from 59.7 to 90% by weight, wherein the resin (a) is amorphous, and wherein the polyhydroxycarboxylic acid skeleton has an optical purity X (%) of 80% or less, the optical purity X (%) is represented by the following formula:

$$X(\%)=|X(L\text{-isomer})-X(D\text{-isomer})|$$

wherein X(L-isomer) and X(D-isomer) represent molar ratio (%) of L-isomer and D-isomer of the optically-active monomer, respectively, and wherein the toner comprises no colorant.

2. The toner according to claim 1, wherein the polyhydroxycarboxylic acid skeleton is formed by polymerizing or copolymerizing a hydroxycarboxylic acid having 3 to 6 carbon atoms.

3. The toner according to claim 1, wherein the binder resin further comprises a resin (b) comprising at least one member selected from the group consisting of a vinyl resin, a polyester resin, a polyurethane resin, and an epoxy resin.

4. The toner according to claim 3, wherein the resin (b) comprises a straight-chain polyester resin.

5. The toner according to claim 1, further comprising a charge controlling agent.

6. The toner according to claim 5, wherein the charge controlling agent is a fluorine-containing quaternary ammonium salt.

7. The toner according to claim 1, further comprising a release agent.

8. The toner according to claim 1, further comprising a layered inorganic mineral that includes interlayer ions, wherein the interlayer ions are partially or completely modified with an organic substance ion.

9. A color toner set, comprising:

a yellow toner comprising a yellow colorant;

a magenta toner comprising a magenta colorant;

a cyan toner comprising a cyan colorant;

a black toner comprising a black colorant; and a transparent toner comprising no colorant, wherein each of the toners comprises a binder resin comprising a resin (a) comprising a polyhydroxycarboxylic acid skeleton formed from an optically-active monomer, wherein the polyhydroxycarboxylic acid skeleton has a weight average molecular weight of from 7,000 to 60,000, wherein the binder resin comprises the polyhydroxycarboxylic acid skeleton in an amount of from 59.7 to 90% by weight, wherein the resin (a) is amorphous, and wherein the polyhydroxycarboxylic acid skeleton has an optical purity X (%) of 80% or less, the optical purity X (%) is represented by the following formula:

$$X(\%)=|X(L\text{-isomer})-X(D\text{-isomer})|$$

wherein X(L-isomer) and X(D-isomer) represent molar ratio (%) of L-isomer and D-isomer of the optically-active monomer, respectively.

10. A developer, comprising:

the toner according to claim 1; and a carrier.

11. An image forming method, comprising:

forming a color toner image on a recording medium with at least one of a yellow toner, a magenta toner, a cyan toner, and a black toner; and forming a covering layer with a transparent toner, the covering layer completely or partially covers a surface of the recording medium on which the color toner image is formed, wherein the yellow toner, the magenta toner, the cyan toner, the black toner, and the transparent toner are included in the color toner set according to claim 9.

12. An image forming method, comprising:

forming an ink image on a recording medium by an ink-jet recording method;

forming a covering layer with the toner according to claim 1, the covering layer completely or partially covers a surface of the recording medium on which the ink image is formed.

13. The toner of claim 1, wherein the polyhydroxycarboxylic acid skeleton comprises units of a polyhydroxycarboxylic acid having 3 to 6 carbon atoms.

14. The toner of claim 1, wherein the polyhydroxycarboxylic acid skeleton comprises units of lactic acid.

15. The toner of claim 1, wherein the optical purity of the polyhydroxycarboxylic acid skeleton is 60% or less.

16. The toner of claim 1, wherein the molecular weight of the polyhydroxycarboxylic acid skeleton is from 10,000 to 20,000.

17. The toner of claim 1, which contains no crystalline resin comprising a polyhydroxycarboxylic acid skeleton.

18. The color toner set of claim 9, wherein each of the toners contains no crystalline resin comprising a polyhydroxycarboxylic acid skeleton.

* * * * *